United States Patent [19]

Baumann et al.

[11] Patent Number: 4,569,337

[45] Date of Patent: Feb. 11, 1986

[54] MASSAGE APPARATUS

[75] Inventors: Peter Baumann, Constance, Fed. Rep. of Germany; Michael Baumann, Kreuzlingen, Switzerland

[73] Assignee: Beltron GmbH, Switzerland

[21] Appl. No.: 540,833

[22] Filed: Oct. 11, 1983

[30] Foreign Application Priority Data

Oct. 12, 1982 [DE] Fed. Rep. of Germany ..... 3237696

[51] Int. Cl.[4] ..... A61H 1/00

[52] U.S. Cl. ..... 128/32; 128/25 B; 128/65; 4/574

[58] Field of Search ..... 128/32, 25 B, 65; 4/574

[56] References Cited

U.S. PATENT DOCUMENTS

| | | | |
|---|---|---|---|
| 3,683,896 | 8/1972 | Peplin | 128/24.2 |
| 3,837,334 | 9/1974 | Johnson | 128/24.3 |
| 3,965,495 | 6/1976 | McNair | 4/182 |
| 4,019,502 | 4/1977 | Elkins | 128/65 |
| 4,057,053 | 11/1977 | Kunz | 128/25 B |
| 4,086,921 | 5/1978 | Gonzales et al. | 128/24.2 |
| 4,184,488 | 1/1980 | Bielich | 128/66 |
| 4,429,687 | 2/1984 | Friedson et al. | 128/24.2 |

*Primary Examiner*—Richard J. Apley
*Assistant Examiner*—Robert W. Bahr
*Attorney, Agent, or Firm*—Steele, Gould & Fried

[57] ABSTRACT

A massage apparatus, comprising: a base member having front and rear massage surfaces, each surface having a pattern of projections for transmitting vibrations; a vibrator for the massage surfaces; first support members formed integrally with and extending from the base member and forming walls of a vessel having the front surface as a bottom; and, second support members extending from the base member opposite to the first support members, the first and second support members holding the base member at an inclined angle such that when the massage apparatus rests on the first support members the rear massage surface can be placed to slope upwardly and away from a user for a dry massage and when the massage apparatus rests on the second support members the front massage surface can be placed to slope upwardly and away from a user for a dry massage when the vessel is empty and a wet massage when the vessel is filled with water, whereby a user may choose between a wet and dry massage and between dry massage by either massage surface merely by reversing the apparatus.

16 Claims, 5 Drawing Figures

MASSAGE APPARATUS

BACKGROUND OF THE INVENTION

The invention relates to a massage apparatus, particularly foot massage, with a support preferably provided with projections and serving as a massage surface and which is vibrated by means of a vibrator.

Such massage apparatus offer the possibility of massaging fatigued or overstressed limbs and thereby stimulating the user's circulation, without need for a masseur. Hitherto, such massage apparatus had a relatively complicated construction and were often uncomfortable to use.

SUMMARY OF THE INVENTION

The object of the invention is to provide a massage apparatus, which is simply constructed, easily operated and universally usable.

This object is achieved by a massage apparatus in which the support serving as the massage surface forms the bottom of a vessel which can be filled with water, which is constructed in one piece with the massage apparatus, i.e. by a massage apparatus which, as desired, can operate with or without a water bath and without using a separate water container.

The back of the vessel base can also serve as a massage surface and the apparatus can be used in the reversed position. The vessel base, whose two sides can be used as a massage surface, inter alia offers the advantage that, without a water bath, as desired, it is possible to function with massage projections with different constructional features.

The vessel base serving as a support can slope, i.e. when used as a foot massage apparatus, preferably slopes upwards and away from the user so that a number of advantages are obtained, particularly in connection with foot massage, which is generally performed in a sitting position. A base sloping upwards and away from the user firstly increases comfort and secondly leads to a considerable water saving, when a water bath is used. As a result of the energy saving obtained, the latter is particularly advantageous when operating with a thermostatically controlled water bath.

According to a preferred embodiment of the massage apparatus according to the invention, an electrical surface heating element is provided for the base acting as a massage surface, so that the possibilities of use and the effectiveness of the apparatus are considerably increased, because the incorporated heating element not only heats the base, but can also heat the water in the vessel.

It is also possible to increase the possibilities of use of the massage apparatus according to the invention by a cushion which can be placed on one and/or the other side of the base and which can compensate or correct for the slope of the latter. The cushion preferably has projections on at least one side. The projections with the base constructed as a massage surface and/or those of the cushion can have different heights and can also be designed with other considerations in mind, so that the number of possible uses for the massage apparatus according to the invention is further increased.

According to a preferred embodiment of the massage apparatus according to the invention, the base constructed as a massage surface is preferably constructed in a plate-like manner and the vibrator and preferably also its drive, are arranged within said base, whose two sides can be used.

Two separate vibrators, preferably operating in staggered manner, can be used for the base constructed as a massage surface and their oscillation intensity, frequency and/or phase are preferably separately adjustable. This leads to the advantage that, if desired, the massage can be carried out at intervals and/or with different intensities, e.g. by superimposing oscillations with a slightly differing frequency.

It is possible to provide for the vibrators and/or the heating of the base, a time switch, whose actuator is preferably provided on the outer wall of the vessel.

The massage apparatus according to the invention can also be provided with a stimulation current device to increase its possible uses and its therapeutic effectiveness.

According to a preferred embodiment, shaped-on, preferably latterally positioned, bow-shaped carrying handles are provided, which serve as supporting elements for the vessel and bring about the sloping position of the base.

In the case of the massage apparatus according to the invention, it is possible to provide an intermediate plate, which can be placed on the base and which on its support side has depressions corresponding to the projections on the base, whereas on the side remote from the base it is preferably flat. Such an intermediate plate offers the advantage that the apparatus user can carry out a foot massage without damage or dirtying the apparatus, without taking off his shoes. To avoid the shoes slipping during massage, the aforementioned intermediate plate can have on the side remote from the base a projecting, all-round rim.

It is possible to provide the massage apparatus according to the invention, belts which can be fixed thereto and by means of which it can be secured to body points or limbs of the user or to other objects, optionally accompanied by the interposing of the wedge-shaped cushion. The cushion can also be equipped with a vibrator and/or a heating system, while belts can also be provided on the cushion.

The aforementioned cushion, which can be placed on either side of the base, can be made from an elastic material, preferably foam rubber.

A remote control system can be provided for the easier operation of the vibrator and/or the heating element.

A preferred embodiment of the massage apparatus according to the invention operates with battery current, which is supplied by batteries arranged within the actual apparatus. The power supply can also take place if desired, from outside the apparatus, particularly during heating.

BRIEF DESCRIPTION OF THE DRAWINGS

Further details, features and advantages of the invention can be gathered from the claims and the following description of a preferred embodiment in conjunction with the drawings, wherein:

DETAILED DESCRIPTION OF THE PREFERRED EMBODIMENTS

Figure 1:
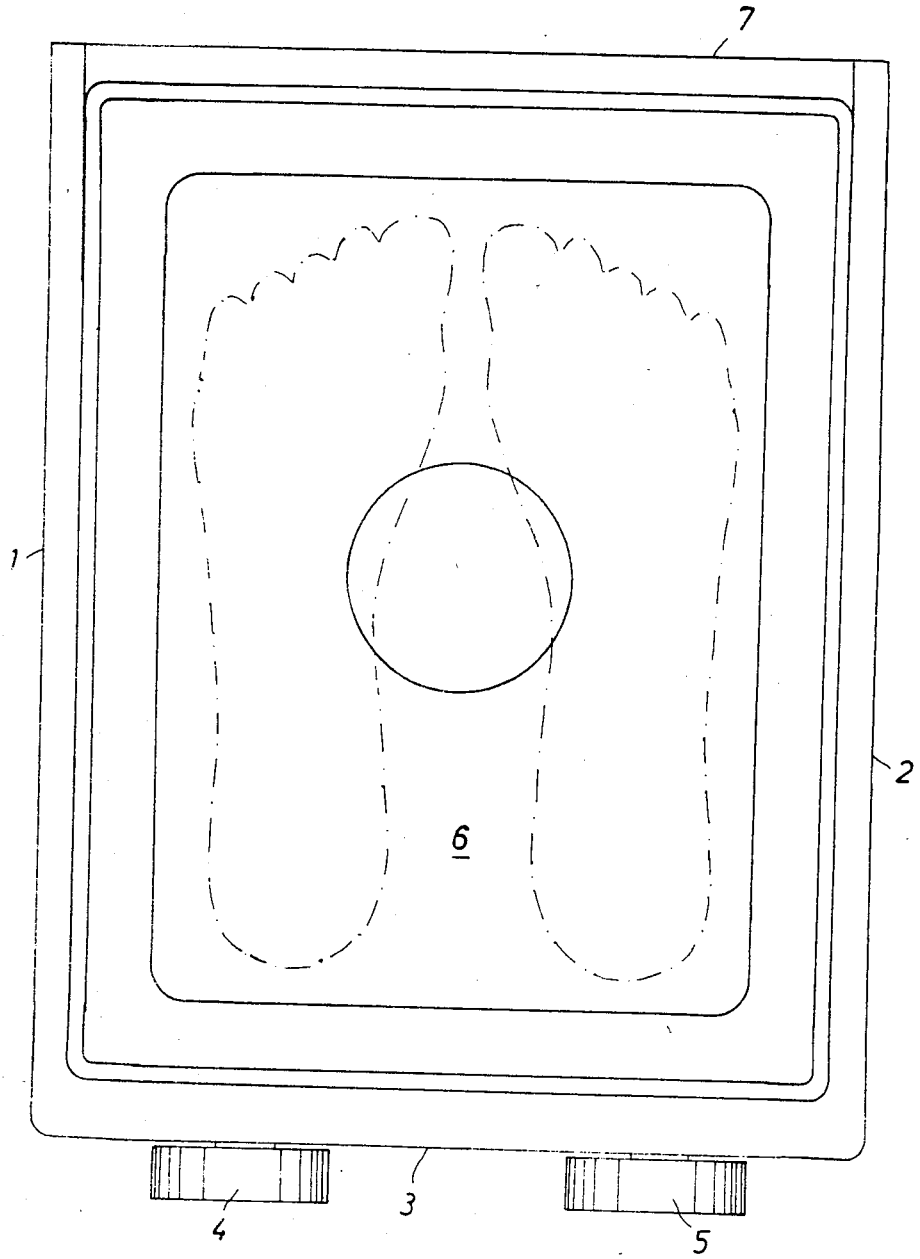
FIG. 1 is a plan view of a massage apparatus according to the invention.
Figure 2:
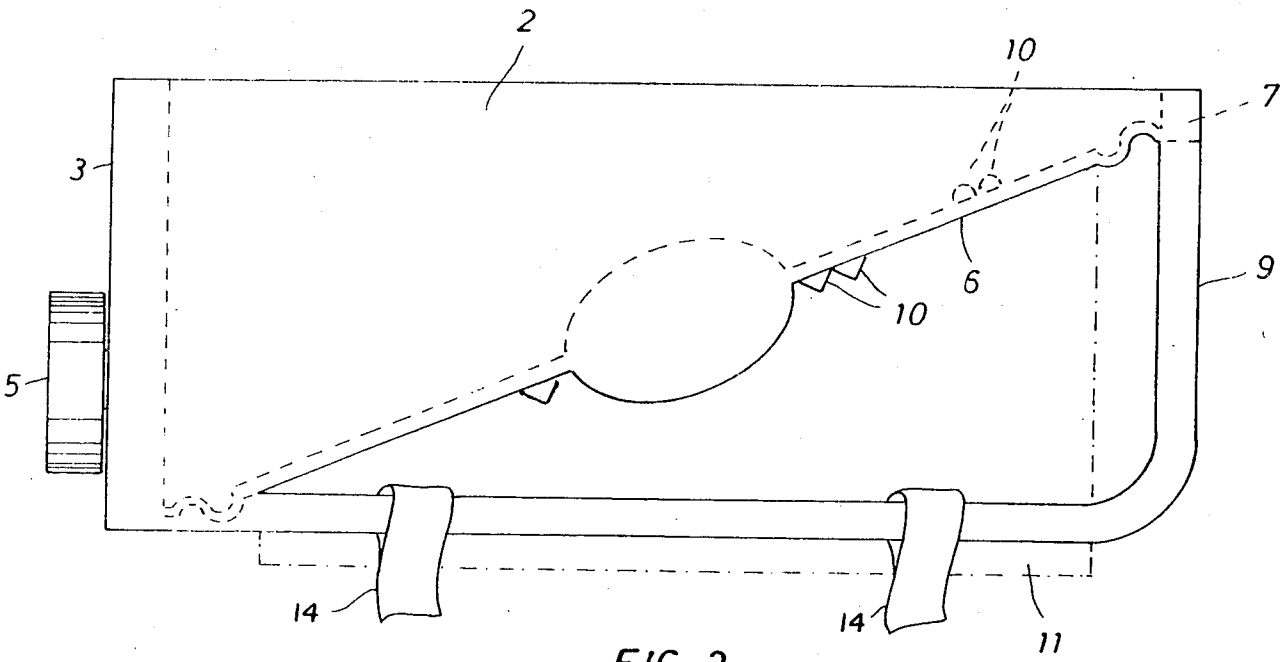
FIG. 2 is a side view of the massage apparatus shown in FIG. 1.
Figure 3:
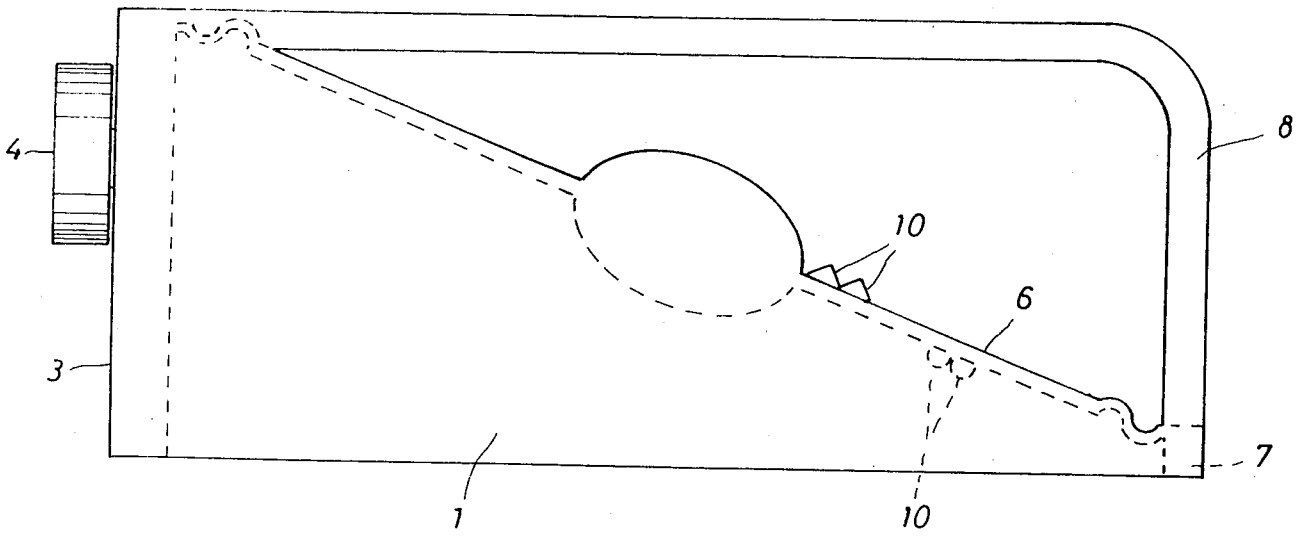
FIG. 3 is a side view of the massage apparatus shown in FIG. 1 in the reversed position.

In plan view (cf FIG. 1), the massage apparatus is substantially rectangular. Its two longitudinal side parts 1, 2, whereof 2 is shown in FIG. 2 and part 1 is shown in FIG. 3, have in each case substantially the shape of a right-angled triangle, whose short side passes into the front side part 3 of the apparatus. Two control knobs 4, 5 are provided on the front side part 3 of the apparatus. The sides of the longitudinal side parts 1, 2, which slope with respect to the horizontal, pass into a substantially plate-like base 6 which, in the view according to FIG. 2, is fixed at the bottom to the front side part 3 of the apparatus and at the top to a web 7 connecting the two longitudinal side parts 1, 2 and with which the front side part 3 of the apparatus is connected by means of two angular clips or legs 8, 9 which, if desired, can be constructed in such a way that they can be removed. Base 6 is hollow and contains an electrical surface heating element regulatable by means of control knob 4 and a centrally arranged vibrator, which can be controlled by means of control knob 5. Both sides of base 6 are constructed as massage surfaces and carry projections 10, whereof only a few are shown in the drawing. The edge areas of base 6 are, as diagrammatically shown, constructed in a corrugated manner, so that the base 6 can, without difficulty, take over the vibrations produced by the centrally arranged vibrator.

Figures 4, 5:
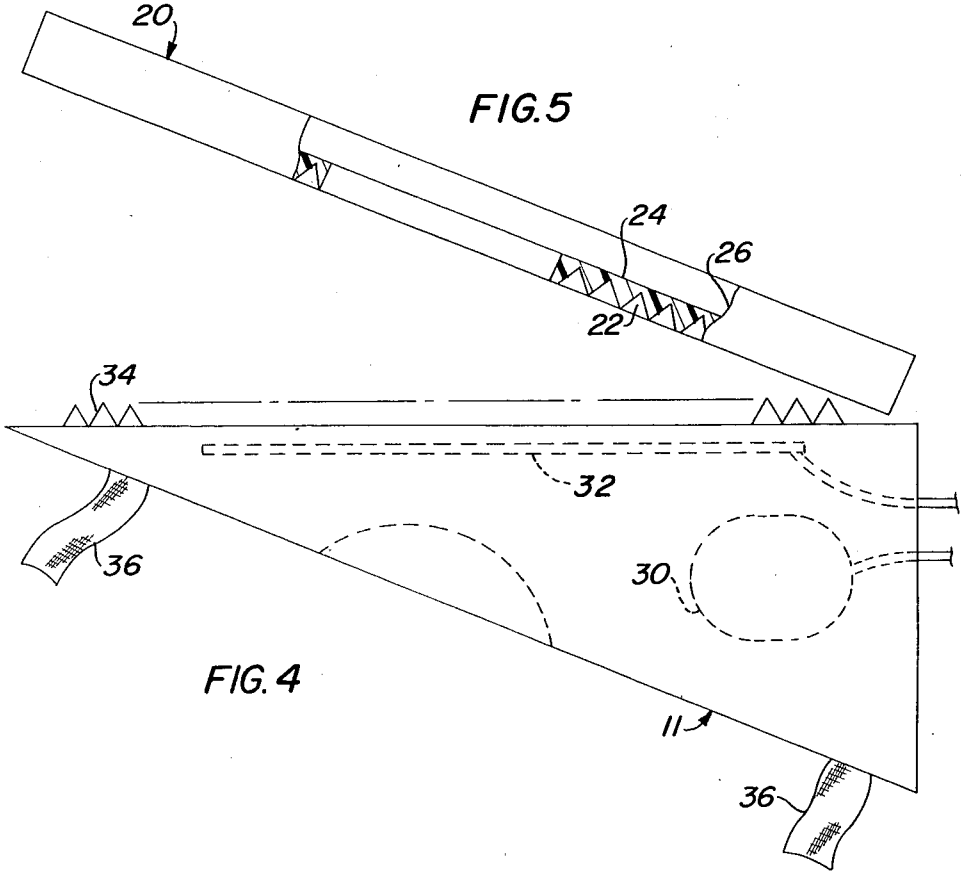
FIG. 4 is a side elevation of a wedge-shaped cushion according to the invention.
FIG. 5 is a side view, partially broken away, of an intermediate plate according to the invention.

A substantially wedge-shaped cushion 11 can be placed on base 6 and is shown in dot-dash line manner in FIG. 2. The height of cushion 11 is preferably such that the clips 8, 9 do not come into contact with the base, when the apparatus is placed thereon in accordance with FIG. 2. Cushion 11, which is preferably made from an elastic material, e.g. foam rubber in this way ensures that the vibrations produced by the vibrator are transferred to the base. The cushion may have a pattern of projections 34 formed thereon as shown in FIG. 4. The cushion can also be provided with a vibrator 30 and/or a heating system 32, or with belts 36 for attaching the cushion to the apparatus or a a user, or perhaps both.

If the massage apparatus is set up in accordance with the view according to FIG. 2, the two longitudinal side parts 1, 2, the front side part 3 and the base 6 define a vessel which can be filled with water, whose bottom slopes upwards and away from the front side part 3 and consequently offers a comfortable foot support position for a person seated in front of part 3 and on which the heels can always be positioned lower then the toes, which helps to ensure a comfortable sitting position. When the user's feet have assumed this position, by operating the frontal control knobs 4, 5, the surface heating element and/or the vibrator arranged in base 6 can be operated, so that the foot massage in the water bath can commence.

If a massage without a water bath is desired, the massage apparatus offers two possibilities, resulting from the fact that base 6 is constructed on both sides as a massage surface and the apparatus can also be used in the reversed position. The two positions in which the massage apparatus can function, are diagrammatically shown in FIGS. 2 and 3. In the position according to FIG. 2, it is possible to operate both with and without a water bath, whereas in the position according to FIG. 3, it is only possible to function without a water bath. In both positions, the base 6 slopes from bottom to top, when viewed by the user. In the position according to FIG. 2, the control knobs point towards the user, whereas in the position according to FIG. 3, they are located on the apparatus side remote from the user.

Clips 8, 9 ensure that the base of the massage apparatus even assumes the favorable sloping position for the user in the arrangement according to FIG. 2 and can also be used as carrying handles. A holding belt 14 can also be fixed to clips 8, 9 and this enables the apparatus to be fixed e.g. to the back of a patient, so that the vibrations produced by the vibrator can be transferred from the base 6, via cushion 11 to the patient's back, without the patient having to continuously hold the apparatus in the desired position.

The current required for operating the vibrator and the heating element can be supplied by batteries arranged in the front side part 3 or by a mains device, for which a socket not shown is provided on part 3.

The two longitudinal side parts 1, 2, the front side part 3, the base 6 and the two clips or legs 8, 9 can be made in one piece from plastic, manufacture preferably taking place by injection molding. As only one side of the base 6, namely the upwardly pointing side in FIG. 2, comes into contact with the water, it is possible to provide on the other side of base 6 a cover, which gives access to the interior of base 6.

The massage apparatus according to the invention may also be provided with an intermediate plate 20 as shown in FIG. 5. Intermediate plate 20 can be placed on the base, having on one side depressions 22 corresponding to the projections on the base, whereas the side 24 remote remote from the base is preferably flat. A peripheral rim 26 prevents shoes from slipping during massage and damaging or dirtying the apparatus. The plate 20 may be provided with an opening to accommodate the blister section of the base in which the vibrator is housed.

In the represented embodiment, the massage apparatus according to the invention constitutes a compact, easily transportable and universally usable apparatus, making it possible to function both with and without a water bath.

We claim:

1. A massage apparatus, comprising:

a base member having front and rear massage surfaces, each surface having a pattern of projections for transmitting vibrations;

means for vibrating the massage surfaces;

first support members formed integrally with and extending from the base member and forming walls of a vessel having the front surface as a bottom; and, second support members extending from the base member opposite to the first support members, the first and second support members holding the base member at an inclined angle such that when the massage apparatus rests on the first support members the rear massage surface can be placed to slope upwardly and away from a user for a dry massage and when the massage apparatus rests on the second support members the front massage surface can be placed to slope upwardly and away from a user for a dry massage when the vessel is empty and a wet massage when the vessel is filled with water, whereby a user may choose between wet and dry massage and between dry massage by either massage surface merely be reversing the apparatus.

2. A massage apparatus according to claim 1, further comprising an electrical heating element disposed in the base between the front and rear massage surfaces.

3. A massage apparatus according to claim 1, further comprising a wedge-shaped cushion adapted to engage either of the front and rear massage surfaces to provide a substantially unsloped massage surface.

4. A massage apparatus according to claim 3, wherein the cushion is formed from an elastic material which promotes transmission of vibrations from the massage surfaces and comprises a pattern of projections at least on one side thereof.

5. A massage apparatus according to claim 4, wherein the massage surfaces are provided with projections having heights which are different than the projections on the cushion.

6. A massage apparatus according to claim 1, wherein the base member is of plate-like construction, the means for vibrating the massage surfaces being disposed within the base member.

7. A massage apparatus according to claim 1, wherein the means for vibrating the massage surfaces comprises two independently operable and adjustable vibrators.

8. A massage apparatus according to claim 2, further comprising a timer switch for controlling at least one of the vibrating means and the electrical heating element.

9. A massage apparatus according to claim 1, further comprising electrical current stimulation means.

10. A massage apparatus according to claim 1, wherein the second support members are adapted for use as bow-shaped carrying handles for the massage apparatus.

11. A massage apparatus according to claim 1, wherein the second support members are detachably connected to the base member.

12. A massage apparatus according to claim 1, further comprising an intermediate plate member having a plurality of depressions on one surface corresponding to the pattern of projections on at least one of the front and rear massage surfaces and having a substantially flat opposite surface, adapted to be placed on the base member and transmit vibrations therethrough.

13. A massage apparatus according to claim 12, wherein the intermediate plate member comprises an upwardly projecting peripheral rim surrounding the flat side.

14. A massage apparatus according to claim 3, further comprising belts adapted for detachable attachment to one of the massage apparatus and the cushion for enabling the massage apparatus to be fixed to different parts of a user's body.

15. A massage apparatus according to claim 2, wherein the cushion comprises at least one of a vibrating means and an electrical heating element.

16. A massage apparatus according to claim 1, wherein the patterns of projections on the front and rear massage surfaces differ from one another in at least one of dimension, shape and relative lateral spacing.

* * * * *

UNITED STATES PATENT AND TRADEMARK OFFICE

CERTIFICATE OF CORRECTION

PATENT NO. : 4,569,337

DATED : Feb. 11, 1986

INVENTOR(S) : Peter Baumann and Michael Baumann

It is certified that error appears in the above-identified patent and that said Letters Patent is hereby corrected as shown below:

Column 3, line 44, delete "a", second occurrence.

Column 4, line 34, delete "remote", second occurrence.

Column 4, line 34, after "base", insert --it--.

Column 5, line 1, "be" should be --by--.

Signed and Sealed this

Seventeenth Day of February, 1987

*Attest:*

DONALD J. QUIGG

*Attesting Officer*

*Commissioner of Patents and Trademarks*